US006579076B2

(12) United States Patent
Narney, II et al.

(10) Patent No.: US 6,579,076 B2
(45) Date of Patent: Jun. 17, 2003

(54) SHAFT LOAD BALANCING SYSTEM

(75) Inventors: John Kenneth Narney, II, Bristol, VA (US); David Turner Monk, Bristol, VA (US)

(73) Assignee: Bristol Compressors, Inc., Bristol, VA (US)

( * ) Notice: Subject to any disclaimer, the term of this patent is extended or adjusted under 35 U.S.C. 154(b) by 118 days.

(21) Appl. No.: 09/766,660

(22) Filed: Jan. 23, 2001

(65) Prior Publication Data

US 2002/0098094 A1 Jul. 25, 2002

(51) Int. Cl.[7] ..... F04B 17/00; F04B 35/00
(52) U.S. Cl. ..... 417/365; 418/55.5
(58) Field of Search ..... 417/365, 357; 415/104; 384/101, 100, 107; 418/1, 55.5

(56) References Cited

U.S. PATENT DOCUMENTS

| | | | | | |
|---|---|---|---|---|---|
| 3,909,081 | A | * | 9/1975 | Wilcock et al. | 384/101 |
| 4,115,038 | A | * | 9/1978 | Lizenberg | 417/357 |
| 4,234,293 | A | * | 11/1980 | Lightle | 417/365 |
| 4,472,107 | A | * | 9/1984 | Chang et al. | 415/104 |
| 4,743,181 | A | | 5/1988 | Murayama et al. | 418/55 |
| 4,836,692 | A | * | 6/1989 | Hagen | 384/107 |
| 4,867,657 | A | | 9/1989 | Kotlarek et al. | 418/55 |
| 4,886,427 | A | | 12/1989 | Sakurai et al. | 417/369 |
| 4,989,997 | A | * | 2/1991 | Yoshimura | 384/100 |
| 5,009,578 | A | * | 4/1991 | Hyland | 417/365 |
| 5,252,046 | A | | 10/1993 | Wen-Ding et al. | 418/55 |
| 5,256,042 | A | * | 10/1993 | McCullough et al. | 418/1 |

FOREIGN PATENT DOCUMENTS

| | | |
|---|---|---|
| DE | 31 33 331 A1 | 3/1983 |
| JP | 60178988 | 9/1985 |

* cited by examiner

*Primary Examiner*—Teresa Walberg
*Assistant Examiner*—Leonid M Fastovsky
(74) *Attorney, Agent, or Firm*—Finnegan, Henderson, Farabow, Garrett & Dunner, LLP

(57) ABSTRACT

A shaft load balancing system includes a housing divided into a first chamber at a first operating pressure and a second chamber at a second, lower operating pressure. A shaft passes from the first chamber into the second chamber. The shaft includes a first end in the first chamber, a second end in the second chamber, and a substantially axial channel connecting the first end and the second end. The first end is in fluid communication with a fluid reservoir in the housing. A reaction member engages the second end. The reaction member includes a compression volume in fluid communication with the channel. A pressure differential between the chambers forces fluid from the fluid reservoir through the channel and into the compression volume. The reaction member transmits the fluid force to the housing, allowing the fluid to create a force on the second end of the shaft.

47 Claims, 4 Drawing Sheets

SHAFT LOAD BALANCING SYSTEM

BACKGROUND OF THE INVENTION

1. Field of the Invention

The present invention relates to a system for balancing loads on a shaft and, more particularly, to a system for balancing pressure-induced, axial shaft loads.

2. Description of the Related Art

Most motor-driven devices utilize a rotating shaft to distribute power from the motor to carry out various operations. In such devices, it is common for unequal loads to develop on opposite ends of the shaft. Load imbalances of this type are particularly common in devices where the ends of the shaft are located in separate compartments having different operating pressures.

One such device is a "split-shell" compressor system having a housing divided into a low pressure compartment containing a motor, and a high pressure compartment containing an oil sump. A shaft extending between the compartments transfers power from the motor to a compressor unit, which compresses a working fluid. In this system, the low pressure compartment is maintained at the suction pressure of the compressor unit, and the high pressure compartment is maintained at the discharge pressure of the compressor unit. This pressure differential between the shaft ends causes an axial load on the shaft.

Loading of this type can cause excessive wear on the shaft's bearings and thrust a surfaces and can cause the compressor to stall under high pressure conditions. These problems result in inefficient operation and shorter operational life of the equipment, thereby increasing operating costs.

SUMMARY OF THE INVENTION

To overcome the drawbacks of the prior art and in accordance with the purpose of the invention, as embodied and broadly described herein, the invention provides a load balancing system for use with a housing divided by a partition into a first chamber at a first pressure and a second chamber at a second pressure lower than the first pressure, the system including a fluid reservoir in the housing, a shaft passing from the first chamber into the second chamber, a channel extending substantially axially through the shaft between a first shaft end and a second shaft end, wherein the first shaft end is in fluid communication with the fluid reservoir, and a reaction member engaging the second shaft end, such that fluid passing through the channel interacts with the reaction member to create a force on the second shaft end approximately equal to a force acting on the first shaft end.

The invention further provides a shaft load balancing system, including a housing, a partition within the housing defining a first chamber at a first pressure and a second chamber at a second pressure, wherein the first pressure is greater than the second pressure, a fluid reservoir disposed in the housing, a shaft extending from the first chamber into the second chamber, the shaft having a first end in fluid communication with the fluid reservoir, and a second end. The invention further provides a substantially axial channel disposed in the shaft between the first end and the second end, and a reaction member disposed in the second chamber engaging the second end, wherein fluid from the fluid reservoir forced through the channel contacts the reaction member and generates a force on the second end approximately equal to a pressure-induced force on the first end.

The invention further provides a system for balancing axial shaft loads, the system including a housing, a partition within the housing defining a low pressure chamber and a high pressure chamber, a fluid reservoir disposed in the high pressure chamber, a rotatable shaft extending from the low pressure chamber into the high pressure chamber through the partition, the shaft including a first end disposed in the high pressure chamber in fluid communication with the fluid reservoir, a second end disposed in the low pressure chamber, and a channel extending substantially axially through the shaft between the first end and the second end. The invention further provides a reaction member sealed with respect to the shaft, the reaction member including a compression volume engaging the second end, such that fluid entering the compression volume from the channel creates an axial force on the second end approximately equal to a pressure-induced force on the first end.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DETAILED DESCRIPTION

Reference will now be made in detail to the present embodiments of the invention, examples of which are illustrated in the accompanying drawings. Wherever possible, the same reference numbers will be used throughout the drawings to refer to the same or like parts.

Figure 1:
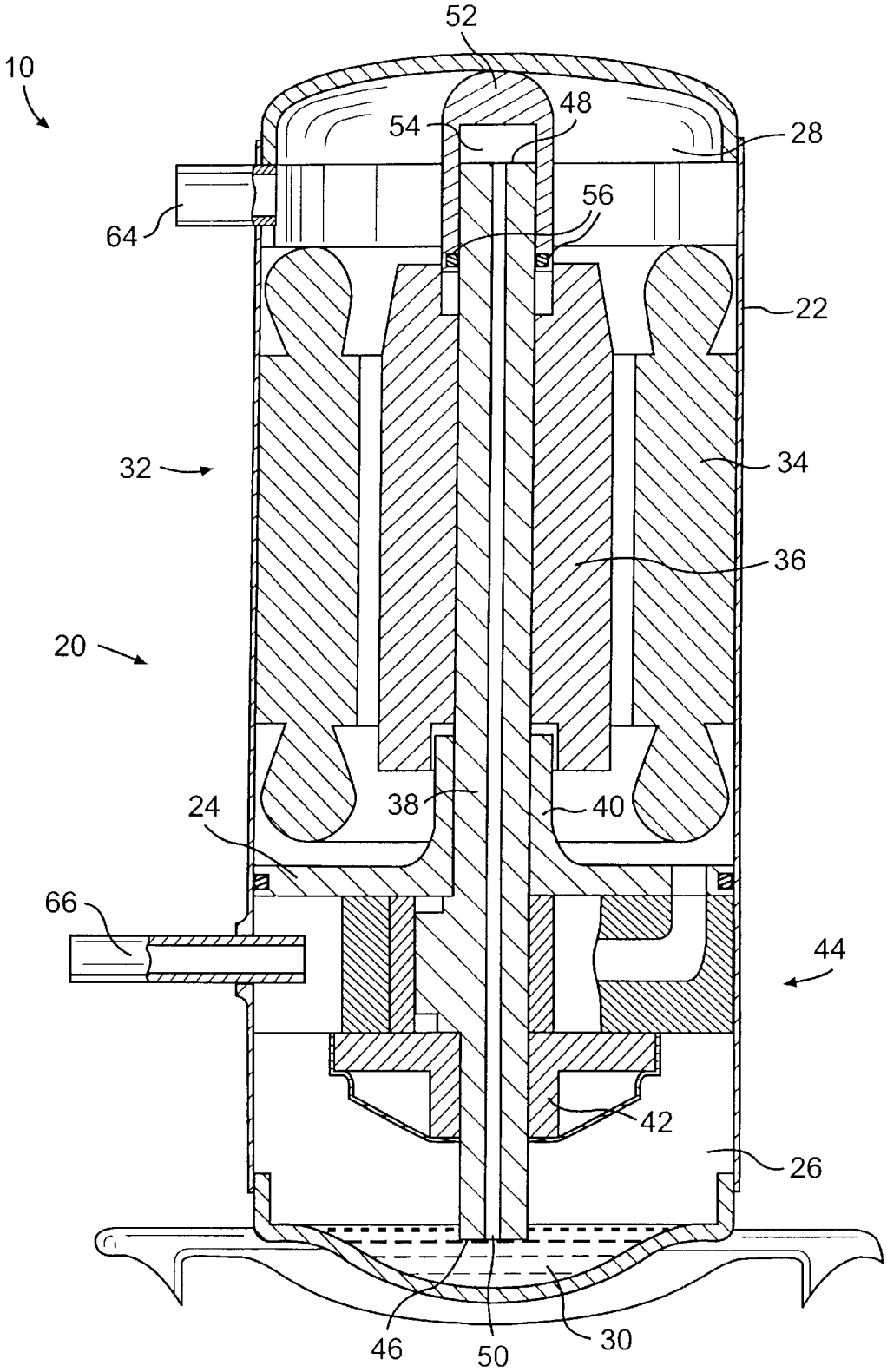
FIG. 1 is a section view of an embodiment of the shaft load balancing system of the present invention.

An embodiment of the shaft load balancing system 10 of the present invention is shown in FIG. 1. The system is shown in use on a compressor system 20, but could be effectively applied in any device having a housing with chambers at different operating pressures, and a shaft with an end disposed in each of the chambers. As used herein, the term "chamber" means an enclosed space.

The system 10 shown in FIG. 1 comprises a housing 22 divided by a partition 24 into a first chamber 26 and a second chamber 28. In the embodiment shown, a fluid reservoir 30 is disposed in the first chamber 26, and a motor 32, comprising a stator 34 and a rotor 36, is disposed in the second chamber 28. In this embodiment, the fluid reservoir 30 is a sump containing oil, although other comparable fluids would perform equally as well. A rotatable shaft 38 is supported by bearings 40, 42 within the housing 22. The shaft 38 passes through the partition 24, extending from the first chamber 26 into the second chamber 28, where it supports the rotor 36. In the embodiment shown, a compressor unit 44 is operatively connected to the shaft 38 in the first chamber 26.

As shown in FIG. 1, the shaft 38 has a first end 46 disposed in the first chamber 26 and a second end 48 disposed in the second chamber 28. The ends 46, 48 of the shaft 38 have an approximately equal projected cross-sectional area. A channel 50 extends substantially axially through the shaft 38 between the first end 46 and the second end 48. As used herein, the term "channel" means a fluid passage. In the embodiment shown in FIG. 1, the first end 46 of the shaft 38 is immersed in the fluid reservoir 30, but other known fluid couplings providing fluid communication between the reservoir 30 and the channel 50 would perform equally as well.

A reaction member 52 engages the second end 48 of the shaft 38 in the second chamber 28. The reaction member 52 is a substantially cup-shaped member, which forms a compression volume 54 when the reaction member 52 is engaged with the shaft 38. Although a cup-shaped reaction member 52 is shown, other shapes providing a suitable compression volume 54 would perform equally as well. As shown in FIG. 1, the compression volume 54 is in fluid communication with the channel 50 in the shaft 38. Further, the reaction member 52 is sealed with respect to the shaft 38 to prevent fluid leakage from the compression volume 54.

Three embodiments of the reaction member 52 are shown in FIGS. 2–6, although other embodiments are considered within the scope of the invention. In each embodiment, the shaft 38 is rotatable with respect to the reaction member 52. Further, the cooperating surfaces of the reaction member 52 and the shaft 38 are sealed by an O-ring 56, or by the running fit between the parts. This alternative sealing arrangement is shown in the split-style drawings of FIGS. 2–6, where the O-ring seal 56 is shown on the left side of the drawing and the running fit seal is shown on the right side. As used herein, the term "running fit" means a clearance between parts that allows relative rotation of the parts, while maintaining an effective fluid seal between the parts. Although two sealing arrangements are described, other known fluid sealing techniques are considered within the scope of the invention.

Figure 3:
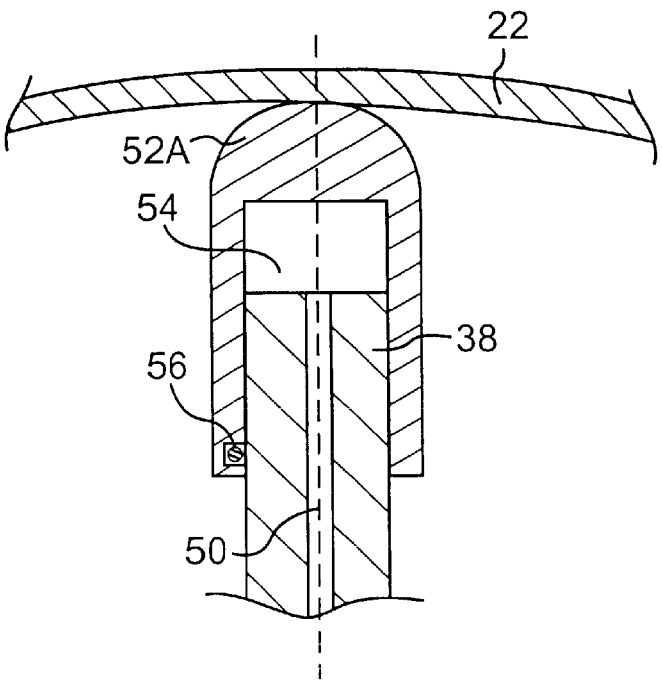
FIG. 3 is a detail view of a first embodiment of the reaction member of the present invention in a second position.
Figure 2:
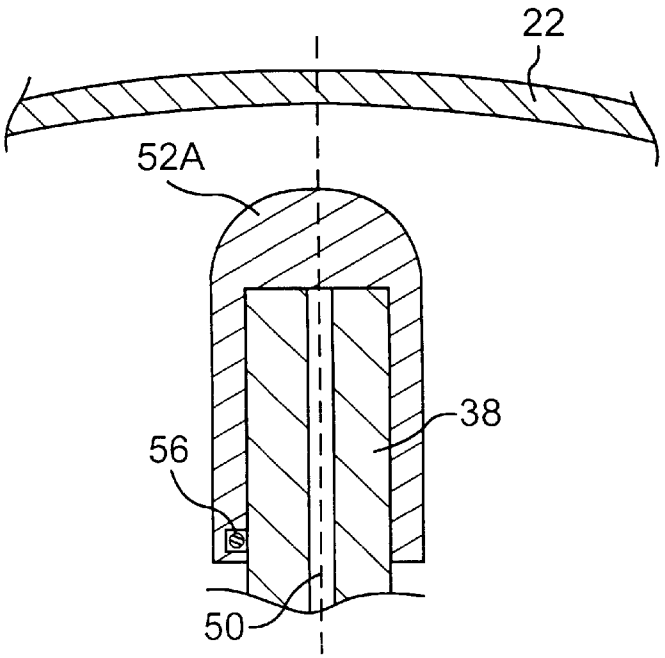
FIG. 2 is a detail view of a first embodiment of the reaction member of the present invention in a first position.

The first embodiment of the reaction member 52A is shown in FIGS. 2 and 3. In this embodiment, the reaction member 52A is axially movable on the shaft 38 between a first position, shown in FIG. 2, and a second position, shown in FIG. 3. The first position corresponds to a minimum compression volume 54, and the second position corresponds to a maximum compression volume 54. The reaction member 52A moves from the first position to the second position under the force of pressurized fluid from the fluid reservoir 30. In the second position, the reaction member 52A contacts the housing 22 and transmits the force from the pressurized fluid to the housing 22, as described below.

In this embodiment, the reaction member 52A is rotatable with respect to the housing 22, and is, therefore, in rotating contact with the housing 22 in the second position. It is desirable to form the upper surface of the reaction member so as to have a minimal contact area, such as a point contact, on the housing 22 to minimize heat generation. A partial spherical shape has been used for the reaction member upper surface, although other shapes may perform equally as well.

Figure 5:
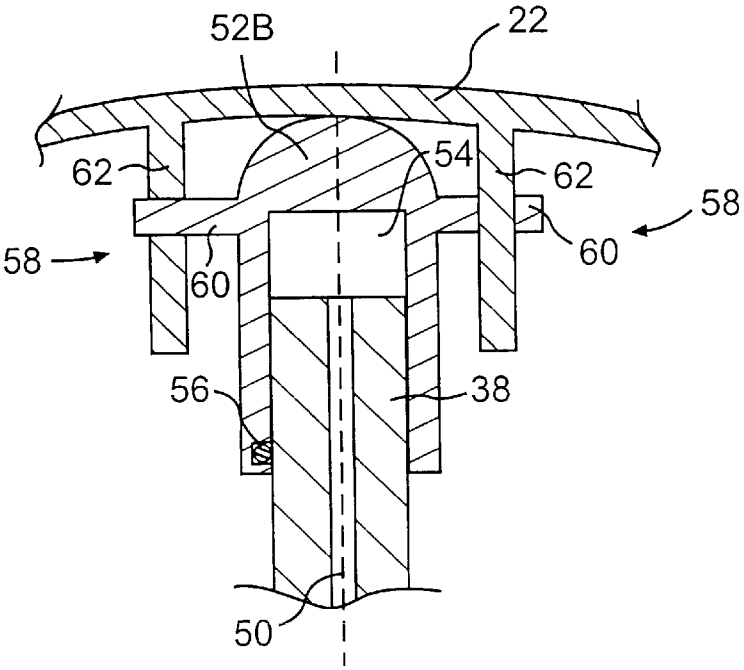
FIG. 5 is a detail view of a second embodiment of the reaction member of the present invention in a second position.
Figure 4:
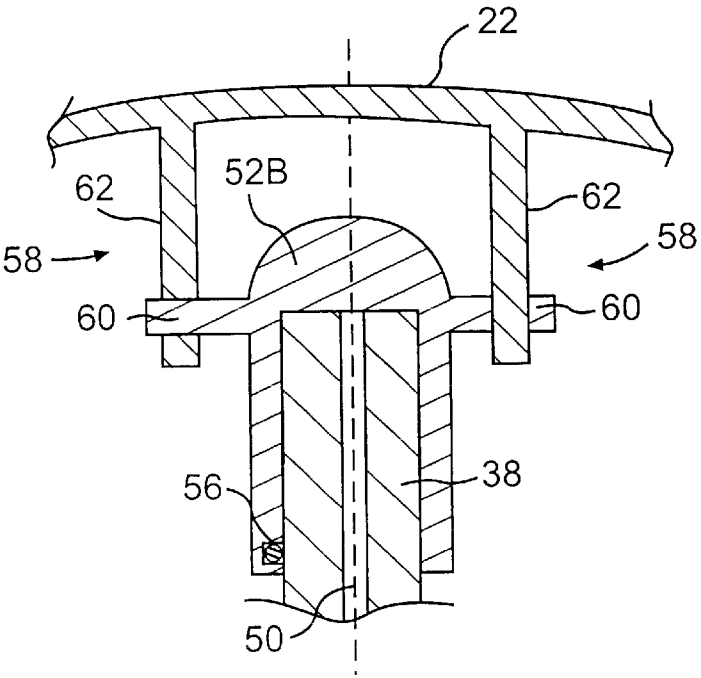
FIG. 4 is a detail view of a second embodiment of the reaction member of the present invention in a first position.

The second embodiment of the reaction member 52B is shown in FIGS. 4 and 5. This embodiment of the reaction member 52B is also axially movable on the shaft 38 between the first and second positions. As in the first embodiment, the reaction member 52B contacts the housing 22 in the second position and transmits the force from the pressurized fluid to the housing 22. In this embodiment, however, the reaction member 52B is constrained against rotation with respect to the housing 22, and is, therefore, in non-rotating contact with the housing 22. The reaction member 52B is constrained against rotation by at least one retention coupling 58.

A retention coupling 58, shown in FIGS. 4 and 5, comprises a first projection 60 on the reaction member 52B and a second projection 62 on the housing 22. Contact between the first and second projections 60, 62 prevents rotation of the reaction member 52B, while the shaft 38 rotates inside the reaction member 52B. It has been found that a symmetrical arrangement of retention couplings 58 equally distributes the constraint forces on the reaction member 52B, and may improve system performance.

In the embodiment shown in FIGS. 4 and 5, two retention couplings 58 are shown having horizontal first projections 60 and vertical second projections 62. However, a system utilizing a different number of retention couplings 58 and/or a different arrangement of projections 60, 62 is considered within the scope of the invention. As used herein, the term "horizontal" means in a plane substantially perpendicular to the axis of the shaft, and "vertical" means in a plane substantially parallel to the axis of the shaft.

In the first and second embodiments shown in FIGS. 2–5, the motion of the reaction member 52A, 52B is not fully constrained in the horizontal direction, allowing the reaction member to follow slight eccentric movement of the shaft 38.

Figure 6:
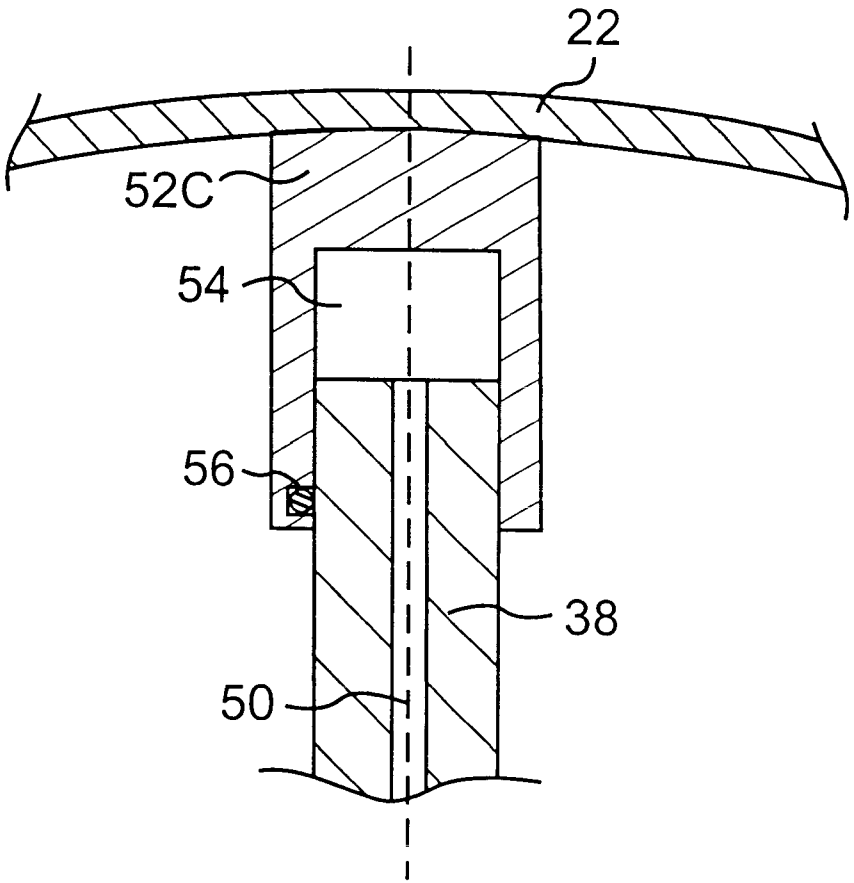
FIG. 6 is a detail view of a third embodiment of the reaction member of the present invention.

The third embodiment of the reaction member 52C is shown in FIG. 6. In this embodiment, the reaction member 52C is fixed to the housing 22. Because the reaction member 52C does not move axially on the shaft 38, the compression volume 54 remains constant. Therefore, no motion of the reaction member 52C is required in order for it to transmit the force of the pressurized fluid to the housing 22. Further, in this embodiment, the reaction member 52C acts as a radial shaft bearing, restraining the radial motion of the shaft 38.

The operation of the shaft load balancing system 10 will now be described with reference to the embodiment shown in FIG. 1. Activation of the motor 32 causes the shaft 38 to rotate, thereby powering the compressor unit 44. The compressor unit 44 draws a working fluid, such as a refrigerant, into the second chamber 28 through a suction tube 64, then into the compressor unit 44, where it compresses the working fluid. The compressor unit 44 discharges the compressed working fluid into the first chamber 26, from which it is expelled through a discharge tube 66. The first chamber 26 is thereby maintained at a first operating pressure and the second chamber 28 is maintained at a second, lower operating pressure. As used herein, the term "operating pressure" means the pressure of the working fluid.

In the particular embodiment described, the first chamber 26 is maintained at the discharge pressure of the compressor unit 44, or high pressure, and the second chamber 28 is maintained at the suction pressure of the compressor unit 44, or low pressure. As used herein, the terms "high pressure" and "low pressure" are relative terms indicating the relative operating pressures of the chambers 26, 28 within the housing 22. They are not used in an absolute sense to indicate specific pressure values.

When the motor 32 is activated, the pressure differential of the working fluid between the chambers 26, 28 increases. The increased pressure of the working fluid in the first chamber 26 increases the pressure of the fluid in the reservoir 30, placing an upward vertical force on the first end 46 of the shaft 38. As the pressure differential between the chambers 26, 28 increases, the fluid, such as oil or other lubricant, is forced from the reservoir 30, through the channel 50 of the shaft 38, and into the compression volume 54 of the reaction member 52.

Regarding the first and second reaction member embodiments 52A, 52B, as the fluid pressure in the compression volume 54 builds, the reaction member 52A, 52B moves axially on the shaft 38 from the first position to the second position. In the second position, the reaction member 52A, 52B contacts the housing 22 and transmits the force from the pressurized fluid to the housing 22, as discussed above. The reaction members 52A, 52B of the first and second embodiments are shown in the first position in FIGS. 2 and 4, respectively, and in the second position in FIGS. 3 and 5, respectively. As discussed above, in the second position, the reaction member 52A of the first embodiment is in rotating contact with the housing 22, and the reaction member 52B of the second embodiment is in non-rotating contact with the housing 22, due to the presence of the retention couplings 58.

Regarding the third reaction member embodiment 52C, shown in FIG. 6, as the fluid pressure in the compression volume 54 builds, the force is immediately transmitted to the housing 22 because the reaction member 52C is directly attached to the housing 22.

For all embodiments of the reaction member 52, the transmission of the fluid force from the reaction member 52 to the housing 22 allows the fluid pressure in the compression volume 54 to build until it is equal to the operating pressure of the first chamber 26. At that point, the fluid in the compression volume 54 generates a force on the second end 48 of the shaft 38 that is approximately equal to the pressure-induced force on the first end 46. The shaft load balancing system 10, therefore, balances the pressure-induced, axial shaft loads.

Because the reaction member 52 operates by equalizing the pressure on opposing ends 46, 48 of the shaft 38, each shaft end should have an approximately equivalent projected cross-sectional area. Unequal cross-sectional areas may result in a load imbalance and a corresponding non-zero axial force on the shaft 38.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A load balancing system for use with a housing divided by a partition into a first chamber at a first pressure and a second chamber at a second pressure lower than the first pressure, the system comprising:

a fluid reservoir in the housing;

a shaft passing from the first chamber into the second chamber;

a channel extending substantially axially through the shaft between a first shaft end and a second shaft end, wherein the first shaft end is in fluid communication with the fluid reservoir; and a reaction member engaging the second shaft end, such that fluid passing through the channel interacts with the reaction member to create a force on the second shaft end approximately equal to a force acting on the first shaft end.

2. The load balancing system of claim 1, wherein a fluid force on the reaction member is transmitted to the housing by contact between the reaction member and the housing.

3. The load balancing system of claim 1, wherein the shaft passes through the partition.

4. The load balancing system of claim 1, wherein the shaft is rotatable.

5. The load balancing system of claim 4, wherein the reaction member forms a compression volume in fluid communication with the channel.

6. The load balancing system of claim 5, wherein the reaction member is sealed with respect to the shaft to prevent fluid leakage from the compression volume.

7. The load balancing system of claim 6, wherein the reaction member is sealed with respect to the shaft by an O-ring seal.

8. The load balancing system of claim 6, wherein the reaction member is sealed with respect to the shaft by a running fit between the reaction member and the shaft.

9. The load balancing system of claim 5, wherein the reaction member is axially movable with respect to the shaft between a first position corresponding to a minimum compression volume and a second position corresponding to a maximum compression volume.

10. The load balancing system of claim 9, wherein the reaction member contacts the in housing in the second position.

11. The load balancing system of claim 9, wherein the reaction member is rotatable relative to the housing.

12. The load balancing system of claim 9, wherein the reaction member is constrained against rotation relative to the housing.

13. The load balancing system of claim 12, wherein the reaction member is constrained by at least one retention coupling, comprising a first projection on the reaction member and a second projection on the housing.

14. The load balancing system of claim 4, wherein the reaction member is fixed to the housing.

15. The load balancing system of claim 14, wherein the reaction member restrains radial motion of the shaft.

16. The load balancing system of claim 1, further comprising:

a compressor unit within the housing drawing a working fluid into the second chamber, compressing the working fluid, and discharging the working fluid into the first chamber, such that the first pressure is compressor discharge pressure and the second pressure is compressor suction pressure.

17. The load balancing system of claim 1, wherein the fluid reservoir is disposed in the first chamber.

18. The load balancing system of claim 1, wherein the cross-sectional area of the first shaft end is approximately equal to the cross-sectional area of the second shaft end.

19. A shaft load balancing system, comprising:

a housing;

a partition within the housing defining a first chamber at a first pressure and a second chamber at a second pressure, wherein the first pressure is greater than the second pressure;

a fluid reservoir disposed in the housing;

a shaft extending from the first chamber into the second chamber, the shaft having a first end in fluid communication with the fluid reservoir, and a second end;

a substantially axial channel disposed in the shaft between the first end and the second end; and a reaction member disposed in the second chamber engaging the second end, wherein fluid from the fluid reservoir forced through the channel contacts the reaction member and generates a force on the second end approximately equal to a pressure-induced force on the first end.

20. The shaft load balancing system of claim 19, wherein a fluid force on the reaction member is transmitted to the housing by contact between the reaction member and the housing.

21. The shaft load balancing system of claim 19, wherein the shaft passes through the partition.

22. The shaft load balancing system of claim 19, wherein the shaft is rotatable.

23. The shaft load balancing system of claim 22, wherein the reaction member forms a compression volume in fluid communication with the channel.

24. The shaft load balancing system of claim 23, wherein the reaction member is sealed with respect to the shaft by an O-ring seal to prevent fluid leakage from the compression volume.

25. The shaft load balancing system of claim 23, wherein the reaction member is sealed with respect to the shaft by a running fit between the reaction member and the shaft to prevent fluid leakage from the compression volume.

26. The shaft load balancing system of claim 23, wherein the reaction member is axially movable with respect to the shaft between a first position corresponding to a minimum compression volume and a second position corresponding to a maximum compression volume.

27. The shaft load balancing system of claim 26, wherein the reaction member contacts the housing in the second position.

28. The shaft load balancing system of claim 26, wherein the reaction member is rotatable relative to the housing.

29. The shaft load balancing system of claim 26, wherein the reaction member is constrained against rotation relative to the housing by at least one retention coupling, comprising a first projection on the reaction member and a second projection on the housing.

30. The shaft load balancing system of claim 22, wherein the reaction member is fixed to the housing.

31. The shaft load balancing system of claim 30, wherein the reaction member restrains radial motion of the shaft.

32. The shaft load balancing system of claim 19, further comprising:

a compressor unit within the housing drawing a working fluid into the second chamber, compressing the working fluid, and discharging the working fluid into the first chamber, such that the first pressure is compressor discharge pressure and the second pressure is compressor suction pressure.

33. The shaft load balancing system of claim 19, wherein the fluid reservoir is disposed in the first chamber.

34. The shaft load balancing system of claim 19, wherein the cross-sectional area of the first end is approximately equal to the cross-sectional area of the second end.

35. A system for balancing axial shaft loads, the system comprising:

a housing;

a partition within the housing defining a low pressure chamber and a high pressure chamber;

a fluid reservoir disposed in the high pressure chamber;

a rotatable shaft extending from the low pressure chamber into the high pressure chamber through the partition, the shaft comprising:

a first end disposed in the high pressure chamber in fluid communication with the fluid reservoir;

a second end disposed in the low pressure chamber; and a channel extending substantially axially through the shaft between the first end and the second end; and a reaction member sealed with respect to the shaft, the reaction member forming a compression volume adjacent to the second end, such that fluid entering the compression volume from the channel creates an axial force on the second end approximately equal to a pressure-induced force on the first end.

36. The system for balancing axial shaft loads of claim 35, wherein a fluid force on the reaction member is transmitted to the housing by contact between the reaction member and the housing.

37. The system for balancing axial shaft loads of claim 35, wherein the reaction member is sealed with respect to the shaft by an O-ring seal.

38. The system for balancing axial shaft loads of claim 35, wherein the reaction member is sealed with respect to the shaft by a running fit between the reaction member and the shaft.

39. The system for balancing axial shaft loads of claim 35, wherein the reaction member is axially movable with respect to the shaft between a first position corresponding to a minimum compression volume and a second position corresponding a maximum compression volume.

40. The system for balancing axial shaft loads of claim 39, wherein the reaction member contacts the housing in the second position.

41. The system for balancing axial shaft loads of claim 39, wherein the reaction member is rotatable relative to the housing.

42. The system for balancing axial shaft loads of claim 39, wherein the reaction member is constrained against rotation relative to the housing.

43. The system for balancing axial shaft loads of claim 42, wherein the reaction member is constrained by at least one retention coupling, comprising a first projection on the reaction member and a second projection on the housing.

44. The system for balancing axial shaft loads of claim 35, wherein the reaction member is fixed to the housing.

45. The system for balancing axial shaft loads of claim 44, wherein the reaction member restrains radial motion of the shaft.

46. The system for balancing axial shaft loads of claim 35, further comprising:

a compressor unit within the housing drawing a working fluid into the low pressure chamber, compressing the working fluid, and discharging the working fluid into the high pressure chamber, such that the low pressure chamber is at compressor suction pressure and the high pressure chamber is at compressor discharge pressure.

47. The system for balancing axial shaft loads of claim 35, wherein the cross-sectional area of the first end is approximately equal to the cross-sectional area of the second end.

* * * * *

UNITED STATES PATENT AND TRADEMARK OFFICE

CERTIFICATE OF CORRECTION

PATENT NO. : 6,579,076 B2
DATED : June 17, 2003
INVENTOR(S) : John K. Narney et al.

It is certified that error appears in the above-identified patent and that said Letters Patent is hereby corrected as shown below:

Column 6,
Line 25, "the in housing" should be change to -- the housing --.

Signed and Sealed this

Nineteenth Day of August, 2003

JAMES E. ROGAN
*Director of the United States Patent and Trademark Office*